US010753141B1

(12) United States Patent
Quinif

(10) Patent No.: US 10,753,141 B1
(45) Date of Patent: Aug. 25, 2020

(54) SPACER FOR HOLLOW-CORE STRUCTURES

(71) Applicant: Edward G Quinif, Scottsdale, AZ (US)

(72) Inventor: Edward G Quinif, Scottsdale, AZ (US)

( * ) Notice: Subject to any disclaimer, the term of this patent is extended or adjusted under 35 U.S.C. 154(b) by 0 days.

(21) Appl. No.: 16/592,343

(22) Filed: Oct. 3, 2019

Related U.S. Application Data

(63) Continuation of application No. 16/577,933, filed on Sep. 20, 2019.

(60) Provisional application No. 62/807,390, filed on Feb. 19, 2019.

(51) Int. Cl.
*E06B 3/70* (2006.01)

(52) U.S. Cl.
CPC ..... *E06B 3/7015* (2013.01); *E06B 3/7001* (2013.01)

(58) Field of Classification Search
CPC ..... E06B 3/7015; E06B 3/7001
USPC ..... 52/784.16
See application file for complete search history.

(56) References Cited

U.S. PATENT DOCUMENTS 2,725,604 A 12/1955 Loetscher
2,754,552 A * 7/1956 Cacciatore ..... E06B 3/7015 428/120
5,670,220 A * 9/1997 Skoien ..... B32B 37/0076 229/120.31
5,832,692 A 11/1998 Opferbeck
5,875,608 A * 3/1999 Quinif ..... B32B 3/28 52/784.14
5,875,609 A * 3/1999 Quinif ..... E04C 2/36 428/116
6,412,251 B1 * 7/2002 Early ..... B61D 17/041 52/49
9,314,983 B2 * 4/2016 Liang ..... B32B 7/14
9,777,532 B2 * 10/2017 Parish ..... E06B 3/7001

* cited by examiner

*Primary Examiner* — Jeanette E Chapman
(74) *Attorney, Agent, or Firm* — Etherton Law Group, LLC

(57) ABSTRACT

This spacer for paneled hollow-core doors has an H-beam configuration, with a first flange connected along its length to a second flange along its length by a web. The web is perpendicular to both the first and second flanges. A hollow-core door is assembled by placing the spacer between two door skins. Once the door is assembled, the web is parallel to the door skins. To accommodate the variation in distance between the bottom and top skins that is created by the raised panels, the bottom edge of each flange has one or more bottom notches that fits closely over the raised portion of the panel in the bottom skin and one or more top notches that fits closely over the raised portion of the panel in the top skin. Preferably only two or three spacers are used in a paneled door, each spacer extending the length of the door.

15 Claims, 9 Drawing Sheets

SPACER FOR HOLLOW-CORE STRUCTURES

CROSS REFERENCE TO RELATED APPLICATIONS

This application is a continuation of U.S. patent application Ser. No. 16/577,933 filed Sep. 20, 2019 and claims the benefit of U.S. Provisional Application No. 62/807,390 filed Feb. 19, 2019.

FIELD OF INVENTION

This invention relates generally to hollow structures made of two parallel skins that form an internal hollow space. This invention relates specifically to a spacer inserted into the hollow space to provide structural support between the skins.

BACKGROUND

Hollow-core doors are commonly used in many types of buildings. The common structure of a hollow-core door includes a pair of door skins that are connected at their perimeters by a rectangular frame, which holds the skins apart to form a hollow space. The skins are commonly made of medium-density fiberboard (MDF), which is an engineered wood product made by combining wood fibers with a binder, and applying high temperature and pressure to mold the fibers into a desired shape. The skins may be formed into completely flat, planar surfaces that are parallel to each other, forming what is known as a flush door, which gives the door a uniform thickness and constant internal width. Alternatively each skin may be formed into a contoured surface with one or more molded panels recessed into the exterior surface of the door, which creates raised panels and panel ridges on the hollow inside of the door. As used herein, parallel skins means that a plane of the bottom skin is parallel to a plane of the top skin, even though the skins may be comprised of multiple planes due to the raised panels. The width of the hollow space between the skins varies across the length and width of the door, as it is reduced by the depth of the raised panel on each skin. This gives the door a non-uniform thickness on the outside and between the skins. A lock block may also be included in the area of the door where locks and handles are attached to provide the additional support that is needed to secure a lock in the door.

As known in the prior art, hollow-core doors are assembled lying flat on a horizontal surface. A bottom door skin is positioned on the horizontal surface with its inside surface 7 facing up. See FIG. 1. Then one or more spacers is attached to the bottom skin and the top skin is placed on top of the spacer(s), forming the door with the hollow interior. The orientations of "top" and "bottom" referenced herein relate to doors and door skins lying horizontally, as opposed to the upright position a door is in when it is opened and closed within a door jamb and lintel.

Hollow-core doors are less structurally sound than solid doors, and more prone to twist and bend. In addition, some hollow-core door skins are so thin that, over the length of a door, the skins tend to sag toward each other. To give the door structural rigidity and prevent the skins from falling into the hollow core, a support structure is placed in the hollow core between the skins and adhered to them. The support structures are usually made of corrugated fiberboard. Corrugated fiberboard is made of a fluted sheet of fiberboard adhered between two flat sheets of fiberboard. Corrugated fiberboard is very resistant to being crushed in a direction parallel to the lengthwise axis of the flutes.

Several types of door support structures are known in the art. For example, U.S. Pat. No. 5,875,608 discloses an expandable spacer that is made of rigid elongated members connected at intersections to foldable connecting members. The elongated members can be collapsed parallel together at the intersections by folding the connecting members, similar to an accordion. When expanded, the elongated and connecting members are at right angles to each other to form a grid or honeycomb pattern. Enough elongated and connecting members are used that the resultant grid fills nearly the entire hollow core. This type of support structure does not provide uniform support within a paneled door, because the spacer rests on the edges and mesas of the raised panels, leaving sizeable gaps between the spacer and the skins where there are no raised panels. Because the grid fills nearly the entire hollow core, the support uses a lot of cardboard, which adds cost and weight.

U.S. Pat. No. 5,875,609 discloses another expandable spacer that accommodates the raised panels by cutting notches in the elongated members where they will cross the raised portions of the panel. The connecting members are not notched. U.S. Pat. No. 5,992,127 discloses another expandable spacer in which both the elongated members and connecting members are notched to accommodate the raised panel portions. Again, enough elongated members and connecting members are used that the resultant grid fills nearly the entire hollow core, resulting in high cost and weight. Unfortunately, these notched expandable spacers are difficult to install because the honeycomb does not stretch evenly, and the notches permit the members to twist and bend at the thinned area, so the spacers are difficult to align where desired.

Such expandable spacers are supplied initially in an unexpanded form to save space during transport and storage. To install between skins, glue is applied to the unexpanded form of the spacer and it is then stretched across one skin of the interior of the door. The second skin is placed on the open glue-covered top surface of the spacer to form the door. One problem with using such an expandable spacer is that it is difficult to stretch in a way that achieves an even grid pattern within the door. Commonly, the spacer must be overstretched and then manipulated into place. This process is labor intensive and thus not a cost effective manner for manufacturing the door. In addition, these expandable spacers fully extend between the horizontal rails and vertical stiles to completely fill the hollow interior. Consequently, more core material is inserted within the interior of the door than is actually required for support. The extra core material increases the cost of the door.

U.S. Pat. No. 6,132,836 discloses a spacer that is not expandable, and is formed by gluing together layers of corrugated fiberboard or expanded or extruded polystyrene foam to form a stack, then cutting the stack perpendicular to the longitudinal axis of the flutes. This results in rigid blocks of corrugated cardboard or polystyrene that can nonetheless be broken into the desired length by hand without scoring. Changing the number of layers changes the thickness of the spacer, so that some blocks are thick enough to support the skins apart at locations without panels, and some are thick enough to support the skins apart at locations with panels. The blocks are glued to the inside of the skins at strategic locations. Each block requires a lot of glue, and because the blocks are not notched, no single block can span a raised portion of the panel. See FIGS. 1 and 2. Another disadvantage of solid blocks spacers is that they too use a large quantity of material, making them more expensive.

FIGS. 1, 2, and 3 show prior art. In one prior art example, a rigid block support 9 is made by stacking corrugated sheets of cardboard on top of each other, gluing the flat surfaces together, and cutting the glued stacks into long rectangular blocks. The rigid block support 9 is initially made in long pieces and then broken into shorter pieces to fit into the desired areas between the skins, such as between raised panels. To make it easier to manually break the long pieces into shorter pieces, the long pieces are perforated along perforation lines 3. See FIG. 2. The perforations reduce the strength of the blocks at the perforations.

To build the door, the rigid block supports 9 are manually broken into appropriately-sized pieces and glue is applied to the fluted edges of the rigid block supports that will rest on the bottom skin 7. The bottom glue-covered portions are placed on the inside surface of a bottom door skin 7 between raised panels 8, with the open ends of the flutes against the skin. See FIG. 1. More glue is applied to the fluted edges of the rigid block supports that the top skin 17 will rest on. The top skin 17 is placed on to on top of the glue-covered spacers, forming the door with the hollow interior.

The rigid block support 9 of the prior art has straight edges 4 along its lengthwise (y) axis. For this reason the rigid block supports 9 are not placed across the perimeter of the raised panels 8 because to do so would cause the straight edge to rest at an angle on the ridge of the panels, effectively raising one end of the rigid block support 9 off the skin. Rigid block supports 9 are not placed directly on the raised panels 8 either, because since the top skin 17 rests on the rigid block supports 9, the width of the hollow interior space would be greatly increased and would leave the hollow areas between the panels completely unsupported. In other words, rigid block supports 9 cannot simultaneously be adhered to both the base and raised portions of the door skins. Because the rigid block supports 9 cannot traverse the raised panels, many rigid block supports 9 pieces are needed to fully support the bottom and top skins apart from each other, requiring time and manual labor for braking the shorter pieces the desired length and placing them all.

In another prior art example, as shown in FIG. 3, the spacer has first and second elongated members 1. A plurality of rigid crossmembers 2 are coupled to and extend between the first and second elongated members 1 in the z-axis. Each crossmember 2 is oriented perpendicularly to the elongated members 1 and to the door skins 7. This forms a series of compartments 5 open to the skins on their tops and bottoms. To build the door, the compartmented supports are broken into appropriately-sized pieces and glue is applied to the fluted edges that will rest on the bottom skin 7. The glue-covered portions are placed on the inside surface of a bottom door skin 7 between raised panels 8, with the open ends of the flutes against the skin. More glue is applied to the fluted edges of the rigid block supports that the top skin 17 will rest on. The top skin is placed on to on top of the glue-covered compartmented spacers, forming the door with the hollow interior.

The compartmented support has a straight edge along its lengthwise (y) axis and suffers the same problems as with the rigid block supports 9 since it cannot be placed across the perimeter of the raised panels without increasing the width of the hollow interior space. Compartmented supports cannot simultaneously be adhered to both the base and raised portions of the door skins.

Tens of thousands of hollow-core doors are made daily in the US; millions every year. Even small reductions of the amount of material, glue, and labor in the manufacturing process can save millions of dollars. Therefore, it is an object of this invention to provide an internal support for a paneled hollow-core door that uses less paper and glue, has a lower cost of materials and labor, takes less time to assemble, and provides more strength to the door than known supports.

SUMMARY OF THE INVENTION

This spacer for hollow-core structures has an H-beam configuration, with a first flange connected along its length to a second flange along its length by a web. The web is perpendicular to both the first and second flanges. A hollow-core door is assembled by placing the spacer between two door skins. Once the door is assembled, the web is parallel to the door skins. To accommodate the variation in the distance between the bottom and top skins that is created by raised panels in the skins, the bottom edge of each flange has one or more bottom notches that fits closely over the raised portion of the panel in the bottom skin and one or more top notches that fits closely over the raised portion of the panel in the top skin. Preferably only two or three spacers are used in a paneled door, each spacer extending the length of the door.

DETAILED DESCRIPTION OF THE INVENTION

Figure 1:
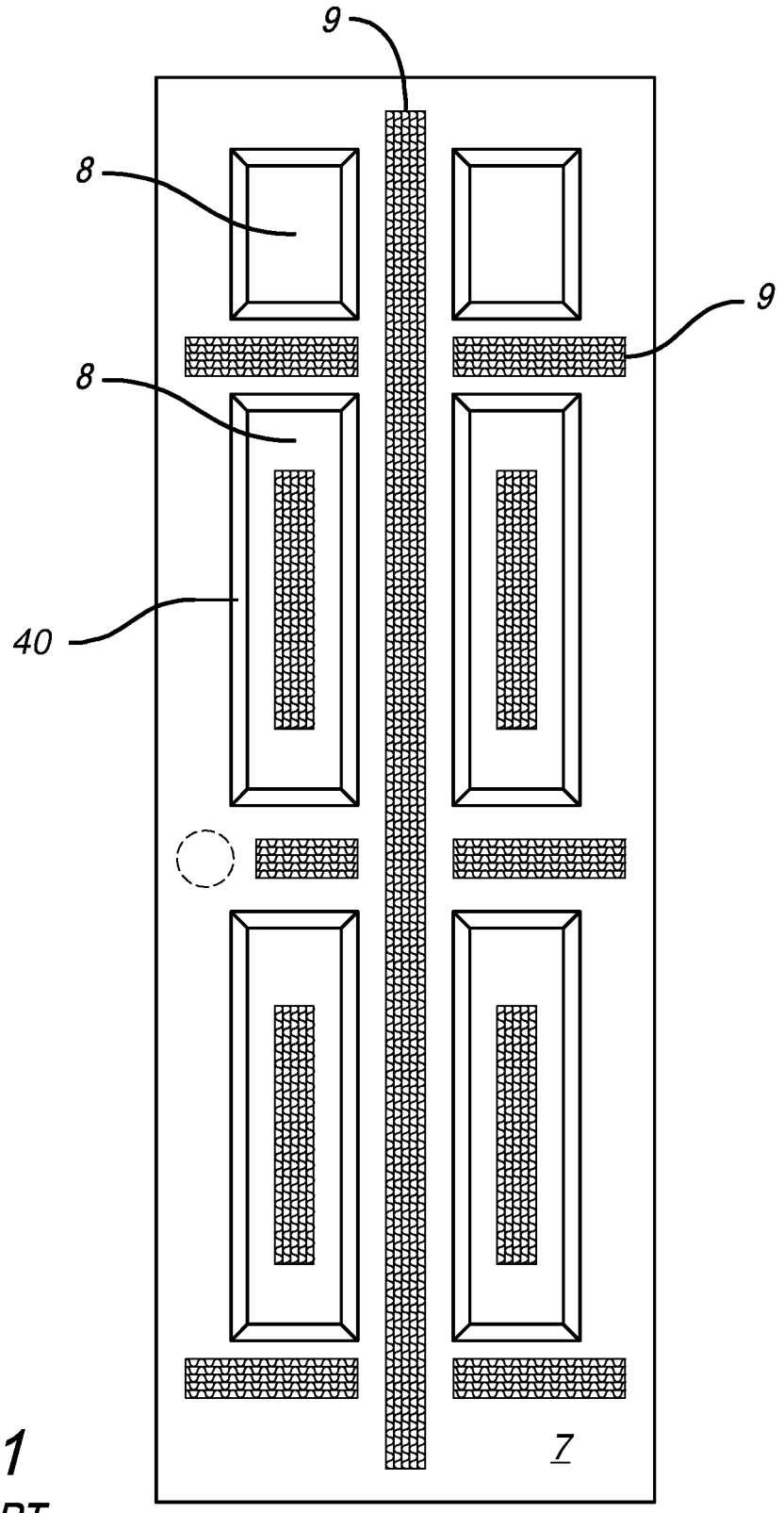
FIG. 1 PRIOR ART
FIG. 1 (PRIOR ART) is a top view of the inside of the bottom skin of a paneled door with rigid block spacers.
Figure 2:
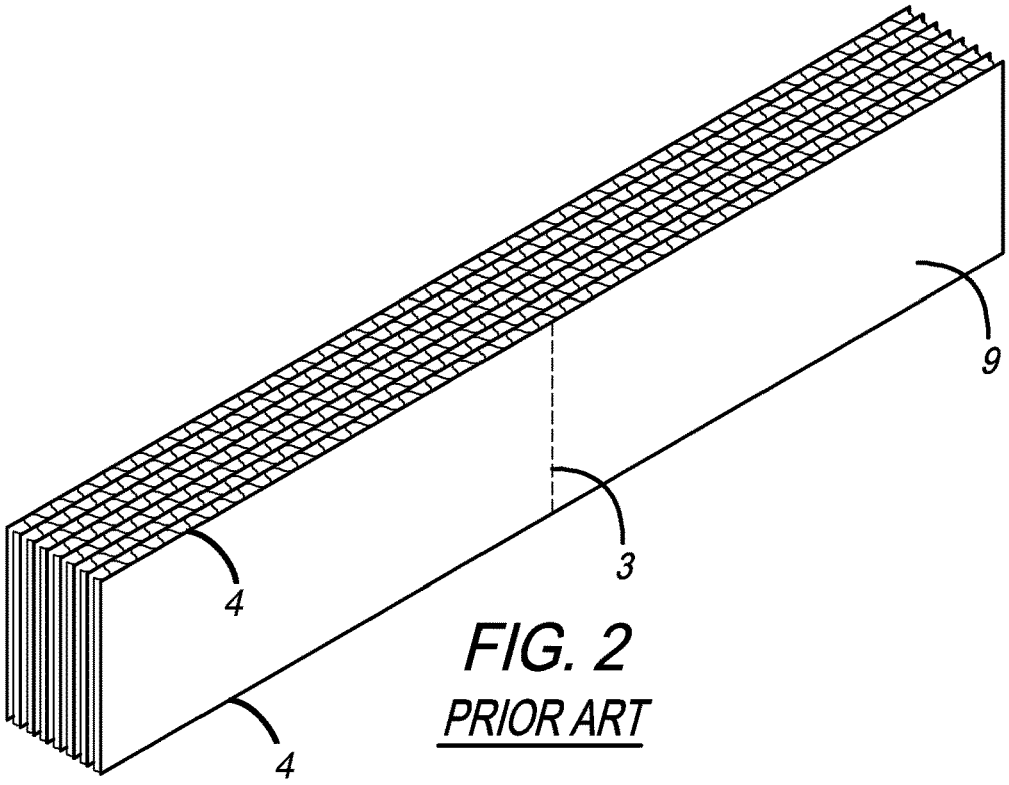
FIG. 2 PRIOR ART
FIG. 2 (PRIOR ART) is a perspective view of a rigid block spacers of FIG. 1 comprising a stack of sheets of corrugated cardboard stacked and glued together.
Figure 3:
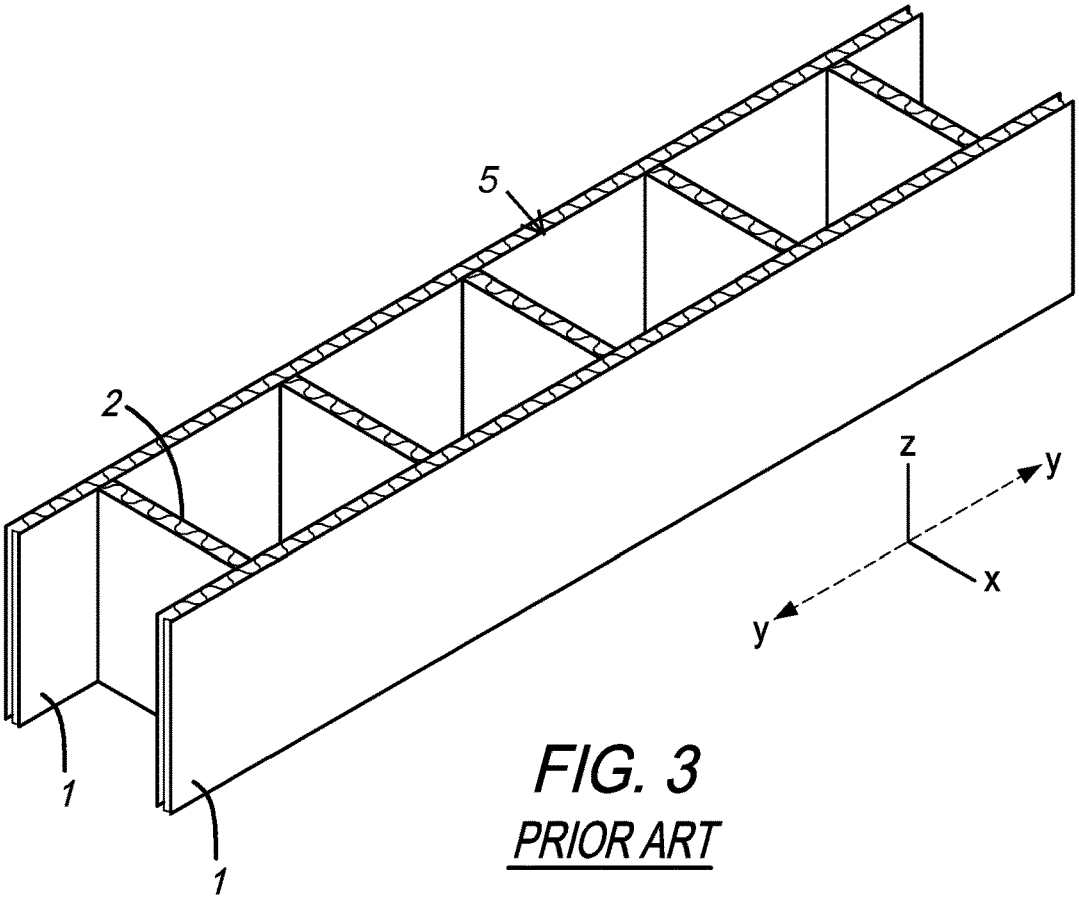
FIG. 3 PRIOR ART
FIG. 3 (PRIOR ART) is a perspective view of a spacer having a crossmember perpendicular to the lengthwise axis of the elongated member and perpendicular to the skin.
Figures 4, 5:
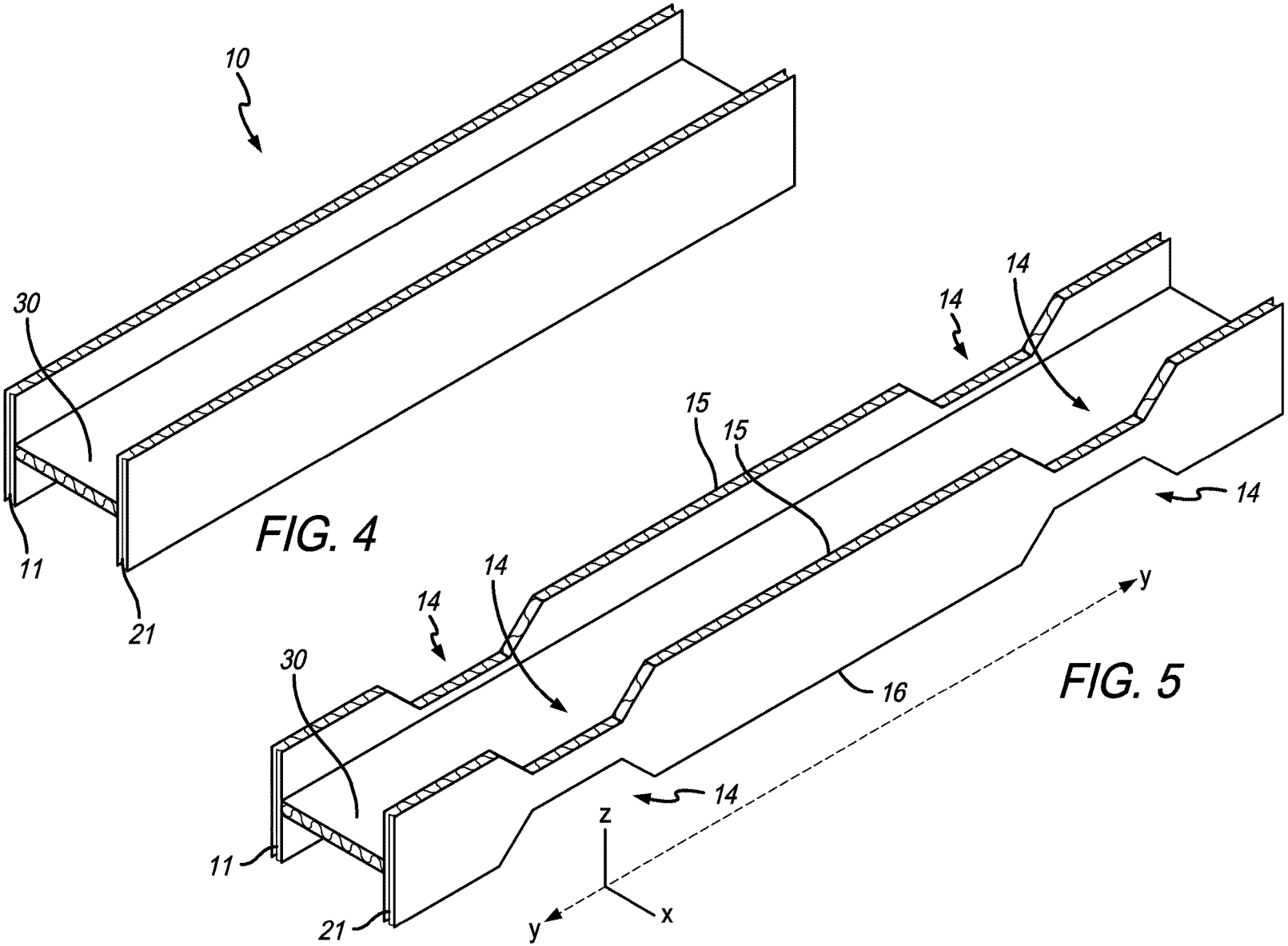
FIG. 4 is a perspective view of one embodiment of the H-beam spacer of the present invention with no notches.
FIG. 5 is a perspective view of another embodiment of the H-beam spacer of the present invention with notches.

The present invention solves the problems of the prior art with a spacer that is made with only a relatively small amount of material, glue, and labor. Referring now to FIGS. 4-11, the present invention is a spacer 10 having an H-beam configuration. That is, the cross section of the spacer looks like an uppercase letter H. A first flange 11 is connected along its length by a web 30 to a second flange 21 along its length. See FIGS. 4 and 5. The spacers of the present invention are explained generally the in context of a hollow-core door, but may also be used in other hollow-core structures, such as tabletops, kick plates, privacy panels for desks, shelves, mantles, and the like.

The first flange 11 and second flange 21 are elongated members oriented parallel to each other and held at a uniform distance apart by the web 30. The flanges 11, 21 are rigid in at least the z-axis and when installed are oriented perpendicular to the door skins. The spacers 10 can be made at or near the desired finished length, for example at or near the length of the inside space, which is the length of the door skins minus the space taken up by the rails. For example, the spacer 10 would be about 77" for a 80" tall door or about 93" for a 96" tall door, This avoids having to later break the spacers into shorter pieces, saving time, labor, and re-work.

The web 30 is a rigid crosspiece and is perpendicular to both flanges 11, 21. Thus, when the spacer 10 is in place between the skins, the web 30 is oriented parallel to the door skins. The web 30 is rigid in at least the x-axis between the flanges to keep the flanges spaced apart the width of the web 30. See FIG. 4. Typically the web 30 is attached to the flanges 11, 21 at the flanges' midline, so that the portion of the flange above the web 30 is about the same as the portion of the flange below the web.

The flanges 11, 21 are typically made of corrugated fiberboard with the openings in the flutes visible along the top edge 15 and bottom edge 16. That is, the flutes are parallel to the z-axis. See FIGS. 4 and 5. Typically the web 30 is also made of corrugated fiberboard with the flutes running parallel to the y-axis. See FIGS. 4 and 5. The long edges (not shown) of the web 30 are attached to each flange where the web and flange intersect. Typically the web is attached to the flanges by glue, paste, tape or other adhesive, but may be attached by alternative means such as by sonic welding, staples, or interleaving such as that used with wine bottle separators used in wine case boxes. Alternatively, the flanges and the web may be made of wood, plastic, metal or one or more other lightweight materials that are rigid in at least one direction so that the flanges can support the skins apart and the web can hold the flanges apart. The flanges and web may be corrugated or non-corrugated, solid or have openings. In some embodiments, the spacers 10 are extruded so that the flanges and web are integral, as opposed to being separate pieces that are attached to each other. The spacers may be used with hollow-core structures that are made of wood, paper, fiberboard, metal, plastic, laminated materials, insulation board, MDF or any panel material.

To accommodate the variation in the distance between the bottom and top skins created by the ridges and mesas of the raised panels, the bottom edge 16 of flanges 11, 21 has one or more bottom notches 14 that fit over the ridges 40 and raised panels in the bottom skin. Top edge 15 of flanges 11, 21 has top notches 14 that fit under the ridges 40 in the top skin. FIGS. 5, 7, 8 and 10 shows notches 14 in the top edges 15 and bottom edges 16 of the flanges. Each notch in the first flange 11 has a parallel counterpart notch in the second flange 21. Given that raised panels 8 are typically of uniform shape and size on both sides of a door, the notches 14 in the top edge 15 are also typically symmetric with the notches 14 on the bottom edge 16. However, it is contemplated that one side of the door may be planar, with no raised panels. In such case the bottom edge 16 of flanges 11, 21 may have notches while the top edge 15 of flanges 11, 21 do not need notches, although they may still be present.

Each notch 14 can be a different depth $d_n$ and width $w_n$ to accommodate the depth $d_p$ and width $w_p$ of each raised panel 8. See FIGS. 7 and 8. Preferably each notch 14 fits snugly against apex or mesa of the raised panel 8, so that the raised panels 8 rest snugly on the notches and the spacer 10 supports the skins 7, 17 apart at a uniform distance along the entire length of the spacer 10. That is, preferably the depth of the notch $d_n$ is the same as the depth of the raised portion $d_p$, and the tolerance is near zero for optimum crush strength of the hollow-core door. See FIG. 8.

Figure 7:
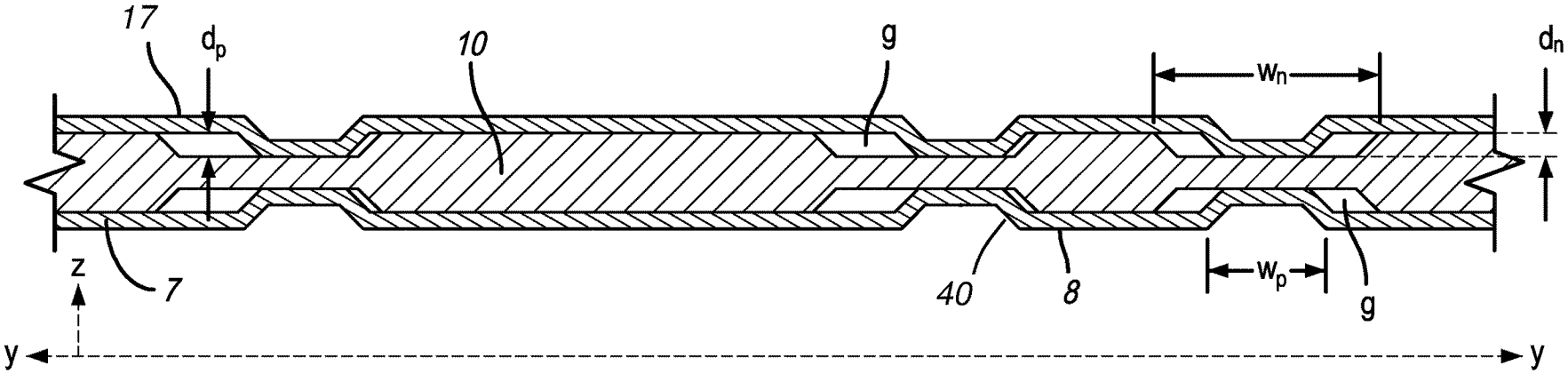
FIG. 7 is a cross-sectional view of the spacer along line 6-6 of FIG. 5 installed between door skins.
Figure 8:
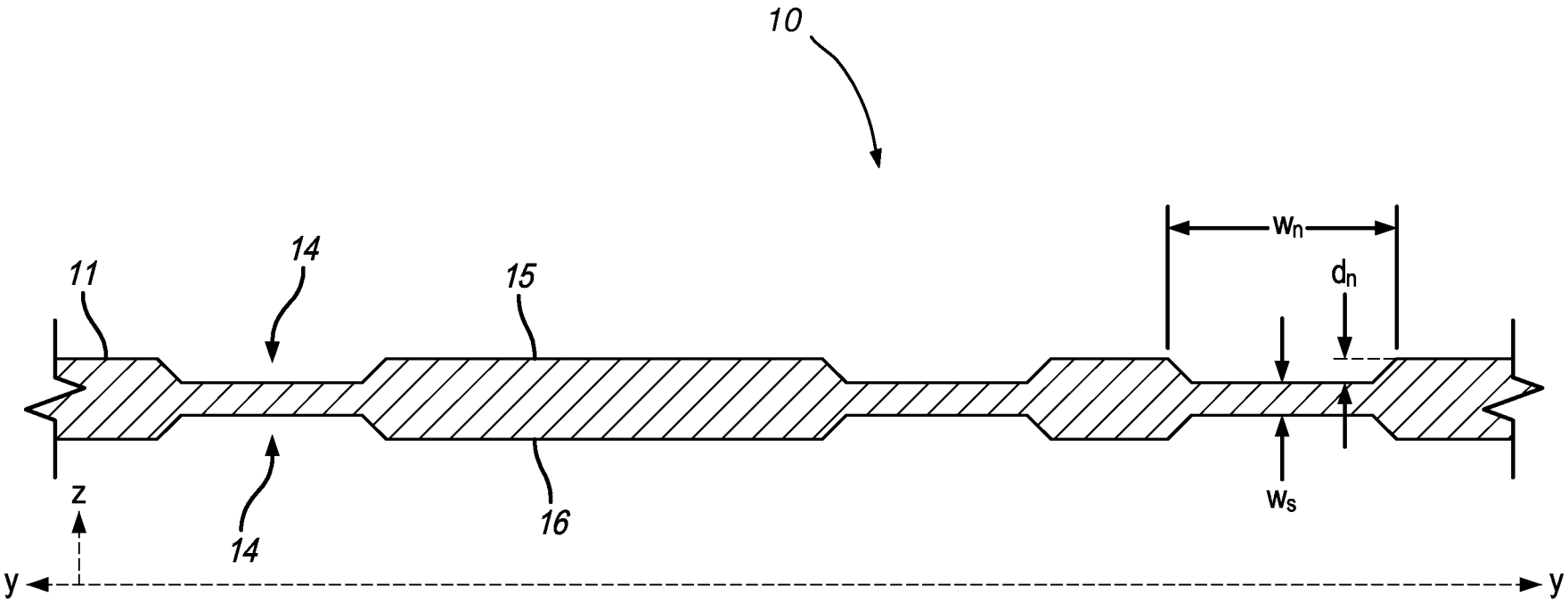
FIG. 8 is a side view of a portion of a spacer of the present invention.
Figure 9:
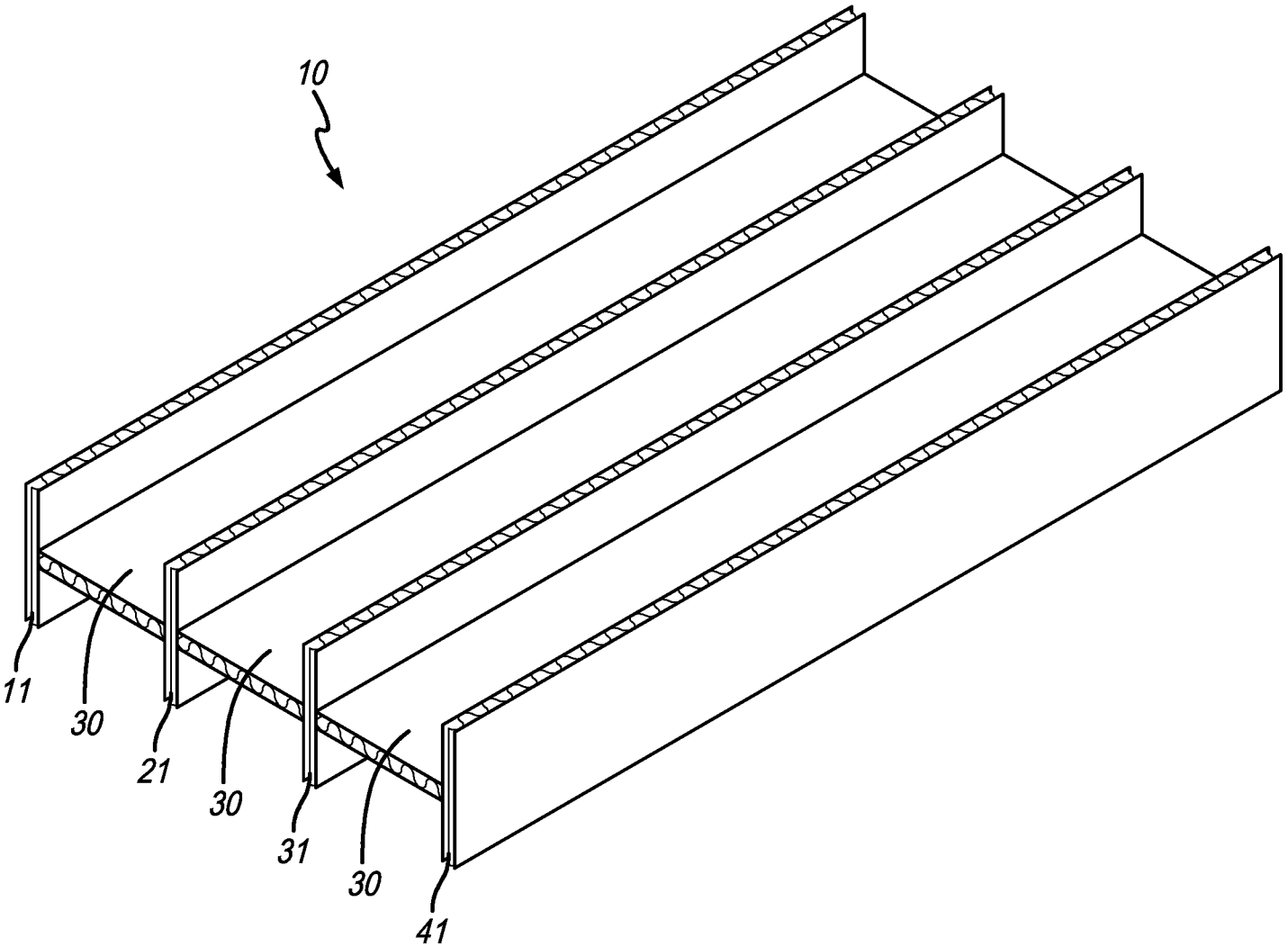
FIG. 9 is a perspective view of another embodiment of the H-beam spacer of the present invention with no notches.
Figure 10:
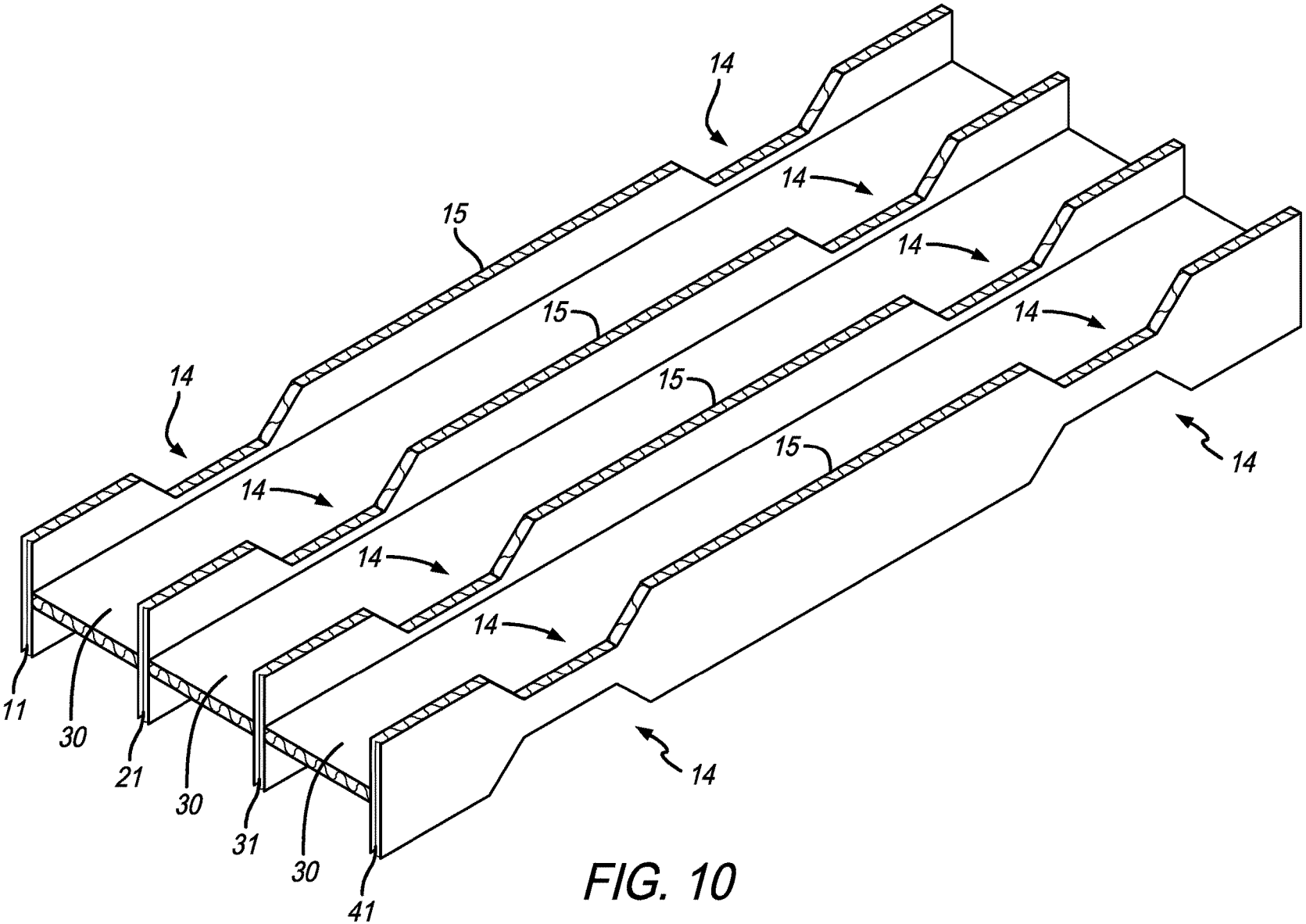
FIG. 10 is a perspective view of another embodiment of the H-beam spacer of the present invention with notches.

Each notch 14 may similarly fit snugly against the ridge 40, but in other cases each notch 14 may be wider than the ridge 40 is long to accommodate size differences or location inaccuracies where the panels are formed, relative to the length of the door. Preferably, each notch 14 is as wide as or wider than the raised panel 8 so that there is some tolerance between the width of the notch 14 and the width of the raised panel, which makes installation easier. The width of the notch $w_n$ does not need to have tolerances as tight as the depth of the notch $d_p$ to maintain optimum crush strength. FIG. 7 shows the effect of having notch widths $w_n$ wider than the width $w_p$ between the raised panel portions, where there are gaps g between the spacer 10 and the door skins 7, 17.

Figure 6:
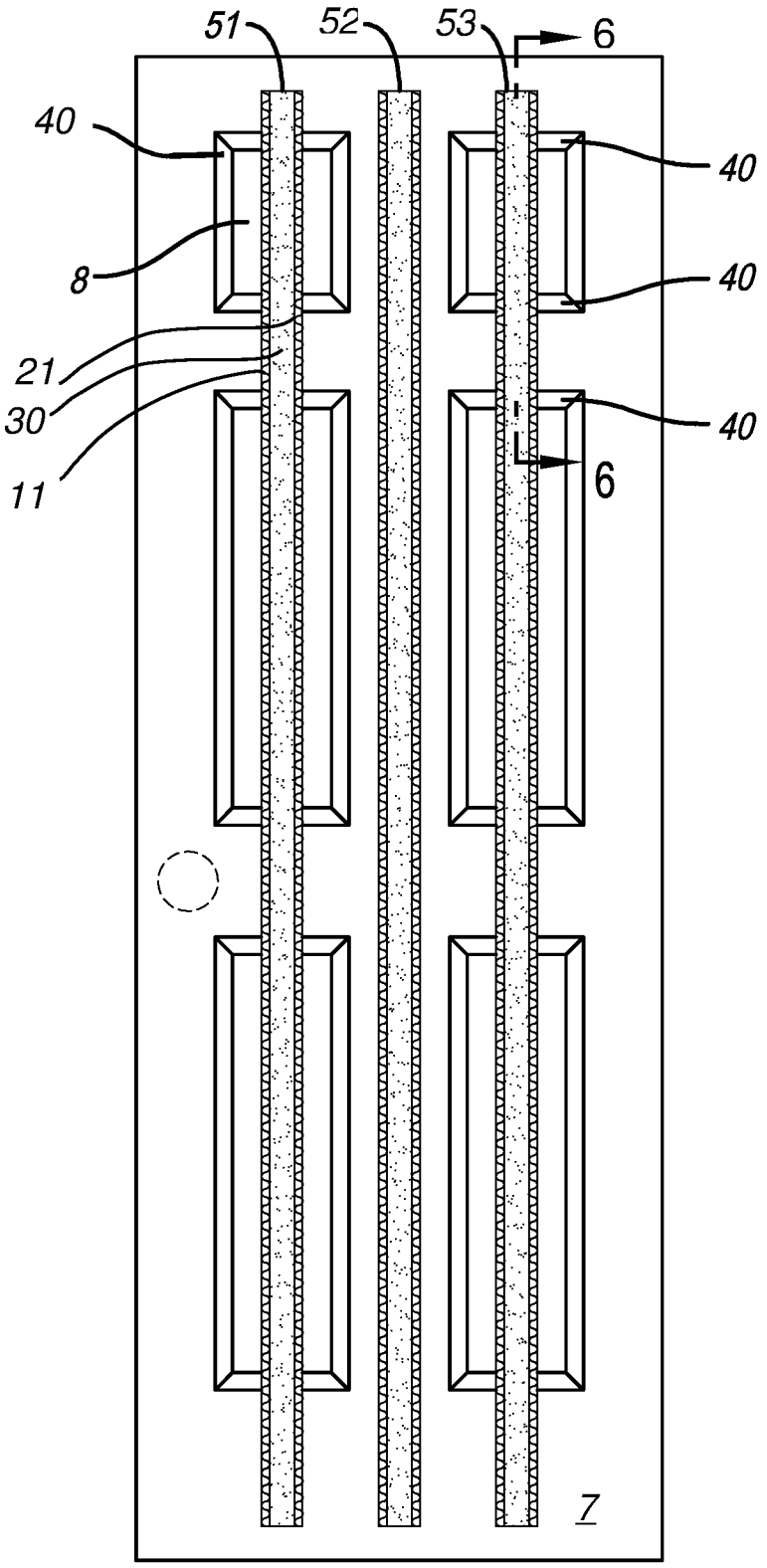
FIG. 6 is a top view of the inside of the bottom skin of a paneled door with spacers of the present invention.

To build the door, glue is applied to bottom edge 15 of the spacer 10, typically by spraying or rolling the glue along the open ends of the flutes that will rest on the bottom skin 7. The glue-covered portions of the spacer 10 are placed on the inside surface of a bottom door skin 7, with the flanges perpendicular to the skin and the cross stroke of the letter H parallel to the skin. Typically the spacers are applied parallel to the long axis of the door, as shown in FIG. 6. More glue is applied to top edge 16 of the spacer 10, again typically by spraying or rolling the glue along the open ends of the flutes that the top skin 17 will rest on. The top skin 17 is placed on to on top of the glue-covered spacers, forming the door with the hollow interior. In a preferred embodiment, glue is put on the entire top and bottom edges 15, 16, including on the sloped and bottom edges of the notches 14. In this way the door skins are attached to the flanges along the entire length of the spacers, adhered to both base and raised portions of the door skins. In another embodiment, glue is applied to both the top and bottom edges of the spacer before the spacer is placed on the bottom skin 7. This embodiment is particularly suited to assembly using robotics, which can move quickly and accurately enough to avoid over application of the glue and quickly enough to avoid the glue drying out before assembly is complete. In yet other embodiments, the glue is applied to the interior sides of the skins, as opposed to applying it to the spacers.

The present spacer 10 is made of significantly less paper than existing spacers, which reduces cost and weight. The present spacer 10 also requires less glue than existing spacers, also reducing cost. And, the present spacer is easier to install than existing spacers, reducing labor and re-work.

Preferably at least two spacers 10 are installed in a hollow paneled door. See FIG. 6. A first spacer 51 is placed over the left column of raised panels 8 and glued in place. A second spacer 52 is placed over the right column of raised panels 8 and glued in place. Optionally a third spacer 53 is glued to the skin between the columns of raised panels 8.

Figure 11:
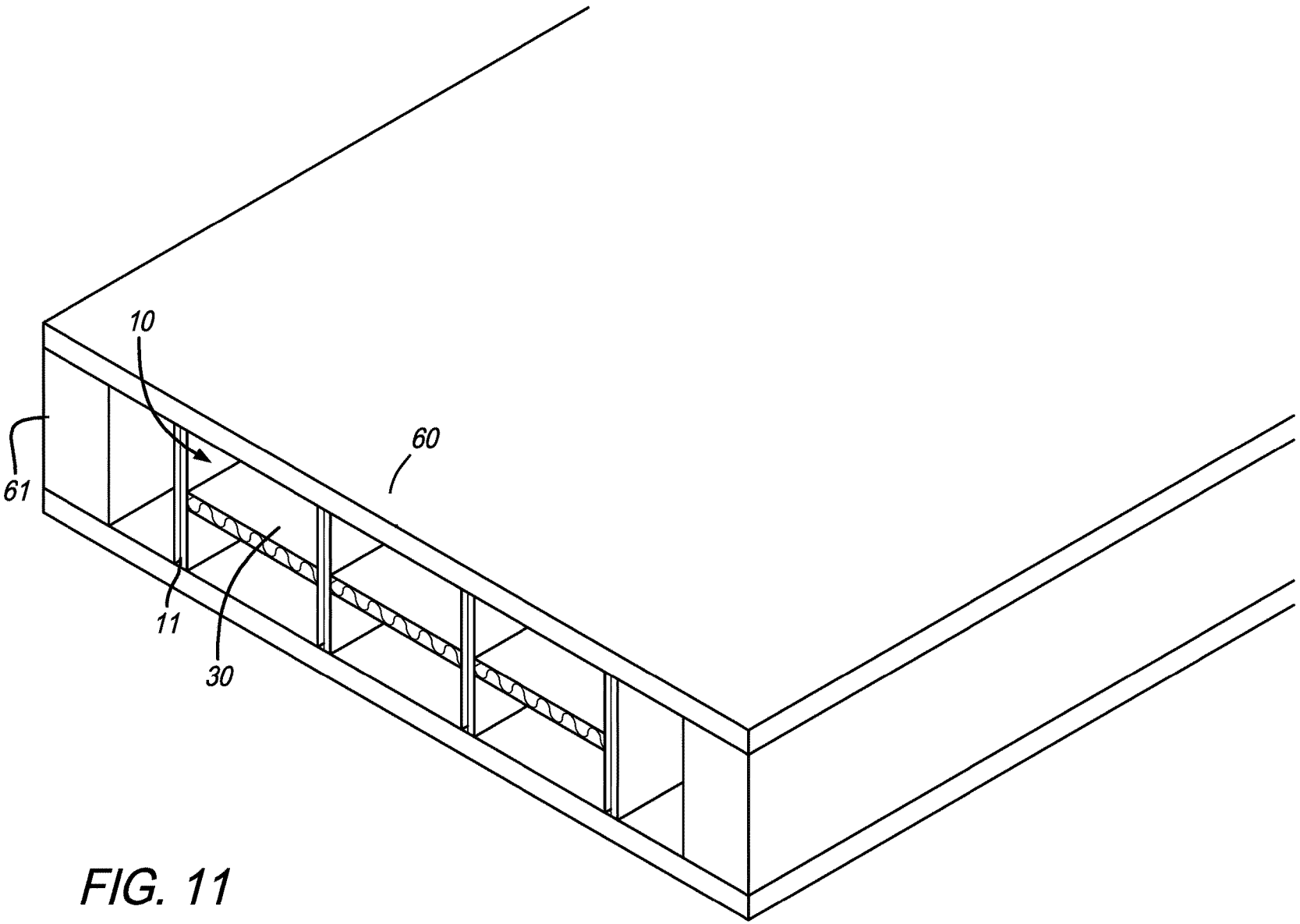
FIG. 11 is a perspective view of the end of a solid panel with a spacer of the present invention.

A second embodiment of the invention adds multiple flanges parallel to the first and second flanges 11, 21, to form a connected series of H-beams. See FIGS. 9 and 10, where a third flange 31 and fourth flange 41 of the series are shown. FIG. 11 shows a perspective view of the end of a solid panel, such as a bookshelf, with a spacer of the present invention. The spacer 10 is sandwiched between two panels 60 and two edge supports 61.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A spacer for installation between a top skin that is parallel to a bottom skin of a hollow-core structure to keep a top skin spaced apart from a bottom skin, the spacer comprising:

a. a first straight flange having a length and a first notch made therein to accommodate a raised panel in the bottom skin;

b. a second straight flange having a length and a second notch made therein to accommodate the raised panel in the bottom skin;

c. a web connecting the first straight flange along its length to the second straight flange along its length, wherein the web is:

i. perpendicular to the first straight flange and the second straight flange; and ii. parallel to the top skin and bottom skin.

2. The spacer of claim 1 wherein the cross section of the spacer has an H-beam configuration.

3. The spacer of claim 1 wherein the first straight flange, second straight flange, and web are made of fiberboard.

4. The spacer of claim 1 wherein the web is connected to the first straight flange and second straight flange with glue or other adhesive.

5. The spacer of claim 1 wherein the spacer has a length at or near the length of the bottom skin.

6. The spacer of claim 5 wherein:

a. the top skin has at least one raised panel; and b. the first straight flange and second straight flange have notches made therein to accommodate the raised panel in the top skin.

7. The spacer of claim 1 wherein the hollow-core structure is a door and the spacer is inside the door.

8. A spacer for a hollow-core structure having a top skin, a bottom skin, a frame separating the top skin and the bottom skin to form a hollow space between the skins in order to keep the top skin spaced apart from the bottom skin, the spacer comprising:

a. a first flange having a length and a first notch made therein to accommodate a raised panel in the bottom skin;

b. a second flange having a length and a second notch made therein to accommodate the raised panel in the bottom skin;

c. a web connecting the first flange along its length to the second flange along its length, wherein the web is perpendicular to the first flange and second flange and parallel to the bottom skin.

9. The spacer according to claim 8 wherein the first flange has notches made therein to accommodate one or more raised panels in the bottom skin.

10. The spacer of claim 8 wherein the cross section of the spacer has an H-beam configuration.

11. The spacer of claim 8 wherein the first flange, second flange, and web are made of fiberboard.

12. The spacer of claim 8 wherein the web is connected to the first flange and second flange with glue or other adhesive.

13. The spacer of claim 8 wherein the spacer has a length at or near the length of the bottom skin.

14. The spacer of claim 13 wherein:

a. the bottom skin and top skin each have at least one raised panel;

b. the first flange and second flange have notches made therein to accommodate the raised panel in the bottom skin; and c. the first flange and second flange have notches made therein to accommodate the raised panel in the top skin.

15. The spacer of claim 1 further comprising:

a. a third straight flange having a length and a third notch made therein to accommodate the raised panel in the bottom skin;

b. a second web connecting the third straight flange along its length to the second flange along its length, wherein the second web is:

i. perpendicular to the third straight flange and the second straight flange; and ii. parallel to the top skin and bottom skin.

* * * * *